US005960870A

United States Patent [19]

Takahashi et al.

[11] Patent Number: 5,960,870

[45] Date of Patent: Oct. 5, 1999

[54] HEAT TRANSFER TUBE FOR ABSORBER

[75] Inventors: Hiroyuki Takahashi; Mamoru Ishikawa; Chikara Saeki; Hiroyuki Kijima, all of Hatano, Japan

[73] Assignee: Kabushiki Kaisha Kobe Seiko Sho, Kobe, Japan

[21] Appl. No.: 09/013,206

[22] Filed: Jan. 26, 1998

[30] Foreign Application Priority Data

Jan. 27, 1997 [JP] Japan ..... 9-012937
Dec. 10, 1997 [JP] Japan ..... 9-340372

[51] Int. Cl.[6] ..... F28F 1/20

[52] U.S. Cl. ..... 165/181; 165/183; 165/177; 165/179; 138/38

[58] Field of Search ..... 165/177, 179, 165/181, 183; 138/38

[56] References Cited

U.S. PATENT DOCUMENTS

| | | | |
|---|---|---|---|
| 3,177,936 | 4/1965 | Walter | 165/179 |
| 3,612,175 | 10/1971 | Ford | 165/179 |
| 3,762,468 | 10/1973 | Newson et al. | 165/177 |
| 3,826,304 | 7/1974 | Withers, Jr. et al. | 165/179 |
| 3,831,675 | 8/1974 | McLain | 165/177 |
| 4,245,697 | 1/1981 | Togashi | 165/179 |
| 4,305,460 | 12/1981 | Yampolsky | 165/179 |
| 4,657,074 | 4/1987 | Tomita et al. | 165/179 |
| 4,690,211 | 9/1987 | Kuwahara et al. | 165/177 |
| 5,573,062 | 11/1996 | Ooba et al. | 165/177 |
| 5,590,711 | 1/1997 | Ishida et al. . | |

FOREIGN PATENT DOCUMENTS

| | | | |
|---|---|---|---|
| 683167 | 3/1964 | Canada | 165/179 |

*Primary Examiner*—James C. Yeung
*Assistant Examiner*—Terrell McKinnon
*Attorney, Agent, or Firm*—Oblon, Spivak, McClelland, Maier & Neustadt, P.C.

[57] ABSTRACT

To provide a heat transfer tube for an absorber in which the quantity of residence of an absorbing liquid on the surface of the tube staying in trough portions is large, and the staying absorbing liquid is thinly and widely spread on the surface of the tube to materially promote an absorbing performance. On an outer surface of a metal tube having an outer diameter of D, a group of N (N is a natural number) number of trough portions, wherein the length L1 in a longitudinal direction of the tube is 70 mm≦L1≦130 mm, and the depth H is 0.23 mm≦H<0.5 mm, is formed on a circumference of a circle formed in section of the tube in the case of being cut perpendicular to a longitudinal direction of the tube so that the pitch P (=π D/N) is set in the range of 6.2 to 8.7 mm, said group of trough portions being formed in plural in a longitudinal direction of the tube, and said group of trough portions adjacent to the longitudinal direction of the tube being arranged so that the ends of each trough portion are entered each other.

3 Claims, 9 Drawing Sheets

HEAT TRANSFER TUBE FOR ABSORBER

BACKGROUND OF THE INVENTION

1. Field of the Invention

The present invention relates to a heat transfer tube for an absorber having an improved absorption performance including a plurality of crest portions and trough portions on the outer surface thereof for use with an absorber in an absorption heat exchanger such as an absorption refrigerating machine, an absorption cooling and heating machine, etc..

2. Description of the Related Art

In an absorption heat exchanger such as an absorption refrigerating machine, the heat exchanger is interiorly held in vacuum, a refrigerant is evaporated at a low temperature, and a cold water is removed by the evaporation latent heat to use the cold water for air conditioning or the like.

An absorber and an evaporator are integrally housed in the body. To continuously obtain evaporation, a refrigerant vapor generated in the evaporator is absorbed in an absorbing liquid scattered on the surface of the heat transfer tube of the absorber to maintain the interior of the body at a given vacuum degree. Accordingly, it is necessary for promoting the refrigeration efficiency of the absorption refrigerating machine and the absorption cooling and heating machine to increase the quantity of generation of the refrigerant vapor in the evaporator and the quantity of absorption, that is, the absorption efficiency. For increasing the absorption efficiency, the promotion of performance of the heat transfer tube is most effective means. Heat transfer tubes having various shapes have been studied and proposed.

For example, in the techniques disclosed in Japanese Utility Model Application Laid-Open No. Hei 2-89270 and Japanese Patent Application Laid-Open No. Hei 2-176378, longitudinal grooves which are continuous in an axial direction of the tube, and crest portions and trough portions formed in a direction at right angles to the axis of the tube have a shape comprising a curvature in a predetermined relationship.

These arts have a feature of not impairing waving of an axial absorbing liquid generated by Marangoni convection. Further, when the absorbing liquid passes from the crest portions to the trough portions, the further turbulence effect is obtained.

Further, the technique formed with intermittent crest and trough portions is disclosed in Japanese Utility Model Publication No. 46-67080 and Japanese Patent Publication No. Hei 5-22838. These arts have a feature that the absorbing liquid is stirred by the intermittent crest and trough portions and the time of residence is prolonged.

However, while the aforementioned conventional arts, the heat transfer performance is promoted to some extent, there were various problems as mentioned below.

First, in the heat transfer tube having the shape in which there is provided the groove which is continuous in the axial direction of the tube, a difference in heat transfer performance occurs depending on the direction of installation of the tube.

More specifically, in the case where the heat transfer tube is arranged so that the trough portions are positioned vertically and upwardly, the absorbing liquid tends to stay in the trough portions so that the absorbing liquid is not well discharged. Therefore, the absorbing liquid whose absorbing efficiency is lowered stays in the trough portions, resulting in the lowering of the heat transfer performance. Further, when the flow rate of the absorbing liquid increases, the absorbing liquid 5 sometimes drops out in the crest portion at the lower part of the tube, in which case also, the heat transfer performance lowers. To prevent these injurious effects, it is effective to arrange a row of groups of tubes so that the crest portions are positioned up. In this case, however, in operation of inserting tubes into the refrigerating machine, it is necessary to proceed the operation while making sure directions one by one, thus imposing a great burden on an operator.

Further, when the wall thickness of the heat transfer tube is decreased, the heat transfer tube is twisted when the former is secured to a tube plate, worsening the distribution of the absorbing liquid to sometimes lower the performance.

Furthermore, since when the depth of the trough portion becomes deepened, the quantity of residence of the absorbing liquid increases, the necessary circulating quantity of the absorbing liquid for driving a refrigerating cycle increases to increase the weight of the machine.

Next, the heat transfer tube disclosed in Japanese Utility Model Publication No. 46-67080 has the intermittent trough portions. As shown in FIG. 6, trough portions 8 are arranged intermittently in a peripheral direction of a tube to constitute a row of a group of trough portions, which is different in circumferential position of the trough portions from that of the adjacent row, and the circumferential positions of the trough portions are superposed on every other row to arrange the trough portions 8. However, in this conventional heat transfer tube, there is present a web-like area where no trough portion is present as viewed axially. For this reason, when the Marangoni convection occurs as the refrigerant vapor is absorbed, the flowing down absorbing liquid rises in a stripe form and flows down while waving in an axial direction of the tube. Therefore, the absorbing liquid does not flow into the trough portions as shown in FIG. 6 depending on places. As a result, there is a disadvantage in that the residence of the absorbing liquid is not sufficient and the absorbing performance will not be promoted.

The heat transfer tube disclosed in Japanese Patent Publication No. Hei 5-22838 relates to an improvement in the construction of the heat transfer tube disclosed in the aforementioned Japanese Utility Model Publication No. 46-67080 but has the problems as follows. That is, the heat transfer tube of Japanese Patent Publication No. Hei 5-22838 has the construction contemplated so that the absorbing liquid can be stayed on the surface of the tube for a period of time as long as possible, in which the absorbing liquid does not pass the protrusions provided intermittently but the absorbing liquid flows down while going round a flat portion between the protrusions.

By the construction as described above, it is possible to prolong the time of residence of the absorbing liquid and increase the quantity of residence of the absorbing liquid. However, since the absorbing liquid stays on the surface of the tube more than as needed, the necessary circulating quantity of the absorbing liquid increases to increase the weight of the machine, as previously mentioned. Further, since a flowpassage of the absorbing liquid is determined by the trough portions and the absorbing liquid does not flow down passing over the top of the protrusions, the top of the protrusion does not contact with the absorbing liquid. Accordingly, a heat transfer area of the heat transfer tube cannot be effectively secured, and there is a limit to promote the heat transfer performance.

In view of the foregoing, the present inventors have proposed a heat transfer tube for an absorber which further promotes the heat transfer performance and promotes the workability when tubes are assembled into a refrigerating machine (Japanese Patent Application Laid-Open No. Hei 8-159605).

According to the above-mentioned prior application, there is provided a heat transfer tube for an absorber for use with an absorber having a plurality of tubes arranged horizontally, characterized in that in a row of trough portions adjacent to each other in a circumferential direction of the tube, a center of one row of trough portions coincides with a center between the other row of trough portions in an axial direction of the tube, the ratio L0/L1 of a length L0 of a superposing portion of the trough portions in the rows adjacent to each other in a circumferential direction of the tube to a length L1 of the trough portions is set in the range of 0.2 to 0.8, the ratio W1/W2 of a width W1 in a circumferential direction of the trough portions to a width W2 in a circumferential direction of the tube of crest portion between the trough portions is set in the range of 0.5 to 2.5, a depth h of the trough portion is set in the range of 0.5 to 1.5 mm, and a length L of the trough portion is set in the range of 10 to 50 mm.

In the thus configured heat transfer tube for an absorber, the row of the intermittent trough portions extending in an axial direction of the tube is arranged so that the ratio of a length of one row of trough portions to a superposing length with the other row of trough portions adjacent thereto has a predetermined value. In the longitudinal groove tube having grooves continuous in an axial direction of the tube, there occurs an unevenness in performance depending on the direction of installation, as previously mentioned. However, in the heat transfer tube for an absorber having the intermittent trough portions, there is no directivity, and even if the upper surface of the tube is arranged in a suitable direction, a substantially given heat transfer performance is exhibited.

Further, a determined flowpassage for the absorbing liquid is not formed but the absorbing liquid flows down while uniformly wetting the tube wall, thus obtaining a high absorption performance.

However, the heat transfer tube for an absorber according to the aforementioned prior application can achieve the intended object, but the quantity of residence of the absorbing liquid on the surface of the tube is less, and the absorption performance is not always sufficient. Because of this, developments of a heat transfer tube for an absorber having a further excellent absorption performance have been desired.

SUMMARY OF THE INVENTION

The present invention has been achieved in view of the problems noted above. It is an object of the present invention to provide a heat transfer tube for an absorber in which the quantity of residence of an absorbing liquid on the surface of the tube staying in trough portions is large, and the staying absorbing liquid is thinly and widely spread on the surface of the tube to materially promote an absorbing performance.

According to the present invention, there is provided a heat transfer tube for an absorber characterized in that on an outer surface of a metal tube having an outer diameter of D, a plurality of groups of N (N is a natural number) number of trough portions, wherein the length L1 in a longitudinal direction of the tube is 70 mm$\leqq$L1$\leqq$130 mm, and the depth H is 0.23 mm$\leqq$H<0.5 mm, is formed on a circumference of a circle formed in section of the tube, the groups being arranged such that for a cut perpendicular to a longitudinal direction of the tube so that the pitch P (=$\pi$ D/N) is in the range of 6.2 to 8.7 mm, said group of trough portions being spaced in a longitudinal direction of the tube, and wherein adjacent ones of said groups the longitudinal direction of the tube are arranged so that the ends of each trough portion of the adjacent groups overlap each other.

In this heat transfer tube for an absorber, preferably, let W1 be the width in the direction perpendicular to the longitudinal direction of the tube of said trough portion formed in the outer surface of the metal tube, and W2 be the width in the direction perpendicular to the tube of a crest portion formed between the trough portions arranged on the circumference of the circle formed in section of the tube in the case of being cut perpendicular to the longitudinal direction of the tube, 0.5$\leqq$W1/W2$\leqq$2.5 is fulfilled. Further, preferably, let L2 be the length of a portion in which the trough portions of the group of trough portions adjacent to the longitudinal direction of the tube are entered (i.e., overlap) each other, 0$\leqq$L2/W1$\leqq$1.2 is fulfilled.

The heat transfer tube for an absorber constructed as described above is arranged horizontally in a vacuum container. A water vapor is absorbed in an absorbing liquid on the surface of the heat transfer tube while flowing down the absorbing liquid from the vertical direction to the longitudinal direction of the tube of the heat transfer tube for heat exchange. In the heat transfer tube for an absorber, the trough portions having a predetermined length in the longitudinal direction of the tube on the outer surface of the metal tube suppress the flow-out of the absorbing liquid in the circumferential direction of the tube and spread the absorbing liquid in the axial direction of the tube to enlarge a wet area necessary for absorbing water vapor. Because of this, the heat transfer tube having the trough portions is excellent in absorbing performance.

The absorbing liquid is stayed in the trough portions in the outer surface of the metal tube, a Marangoni convection occurs in the residual liquid portion due to a liquid concentration difference to even the concentration of the absorbing liquid so that a water vapor absorption efficiency is maintained. The performance of the absorber is further promoted by the residence of the absorbing liquid.

Since the trough portions are divided by a predetermined length in the longitudinal direction of the tube of the metal tube, a flow-down part of the absorbing liquid from the metal tube is divided at intervals of length of the trough portions, and no deviation in flow-down of liquid caused by the angle of installation, bend and the like of the metal tube occurs. Because of this, even in the case where the heat transfer tubes are installed horizontally in a multi-stage fashion for use, no difference in performance due to the position of installation of the heat transfer tubes occurs, thus promoting the performance of the absorber.

DETAILED DESCRIPTION OF THE PREFERRED EMBODIMENTS

Figure 1:
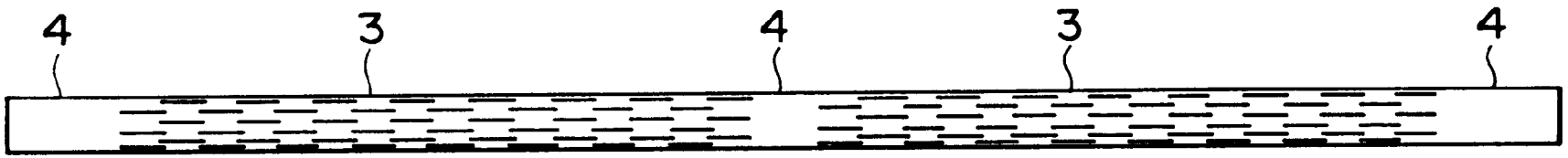
FIG. 1 is a side view showing a heat transfer tube for an absorber according to an embodiment of the present invention.
Figure 2:
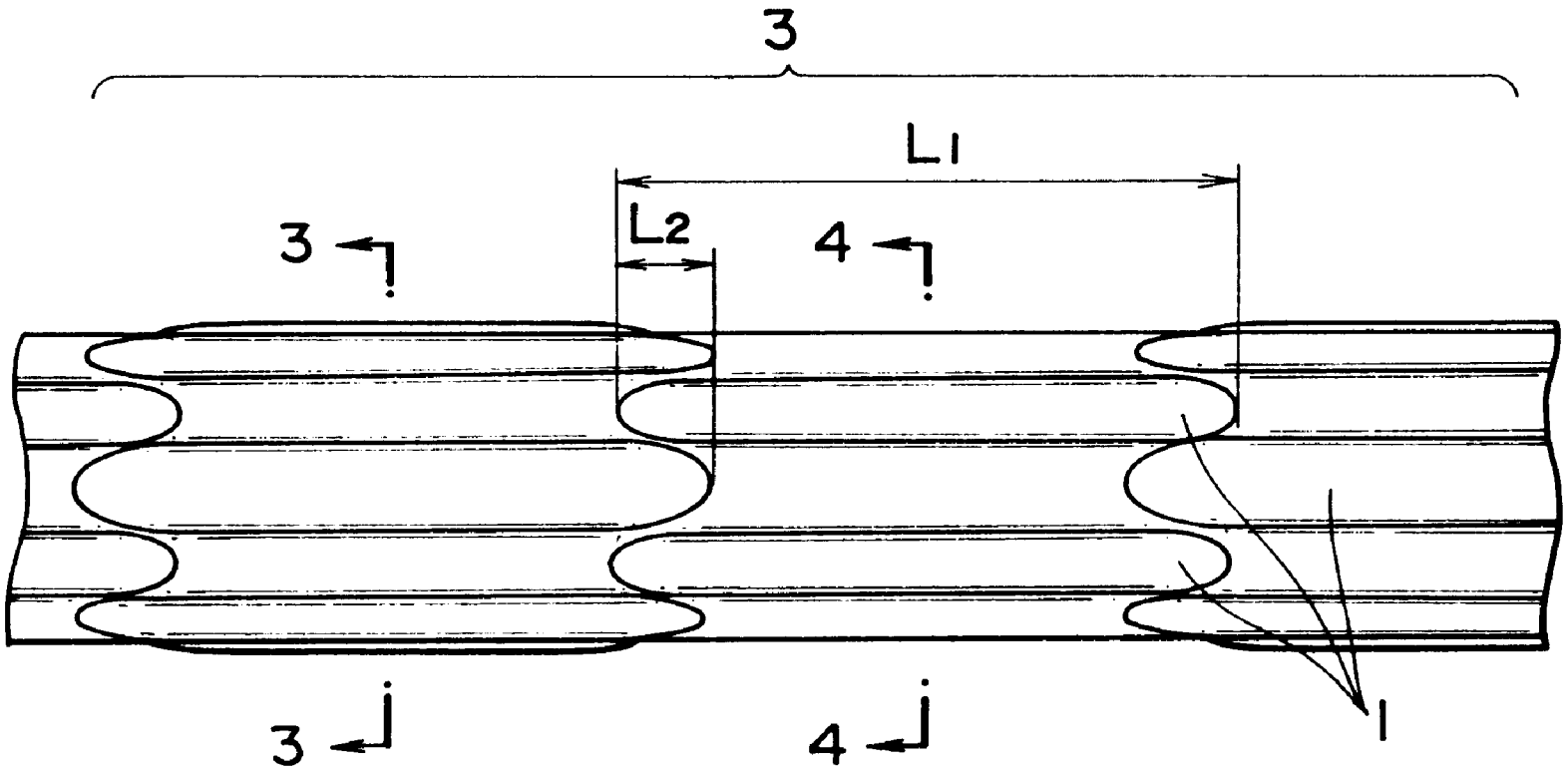
FIG. 2 is a partly enlarged view thereof.
Figure 3:
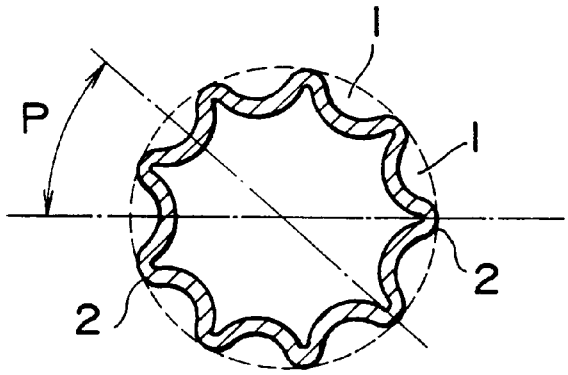
FIG. 3 is a sectional view taken on line 3—3 of FIG. 2.
Figure 4A:
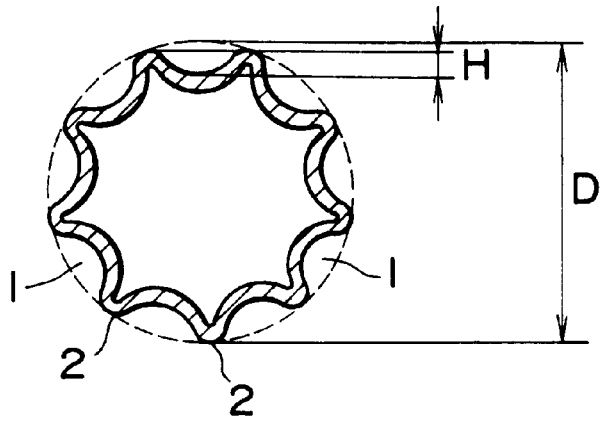
FIG. 4 (*a*) is a sectional view taken on line 4—4 of FIG. 2, and FIG. 4 (*b*) is a partly enlarged view thereof.
Figure 4B:
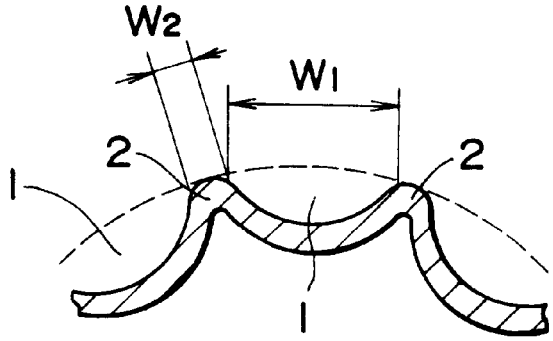
Figure 5:
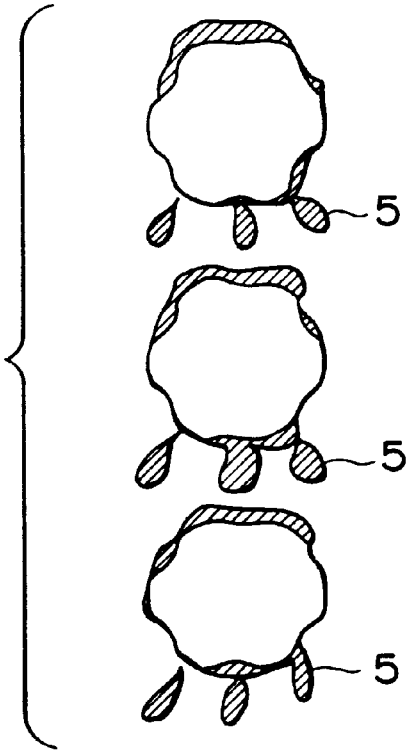
FIG. 5 PRIOR ART
FIG. 5 is a schematic view showing the state in which in a conventional heat transfer tube a drop-out occurs in the absorbing liquid.
Figure 6:
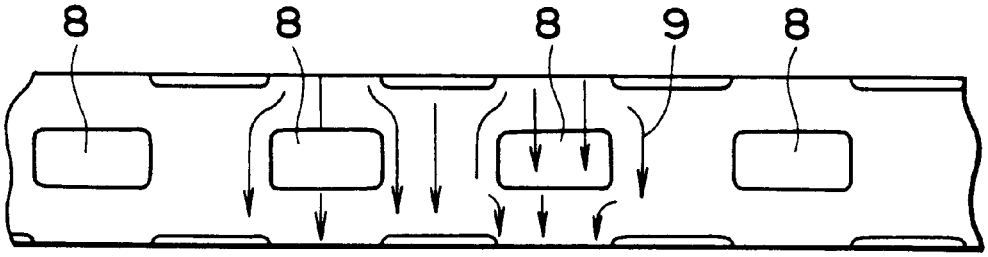
FIG. 6 PRIOR ART
FIG. 6 is a view showing the flow-down state of the absorbing liquid according to the conventional heat transfer tube.
Figure 7:
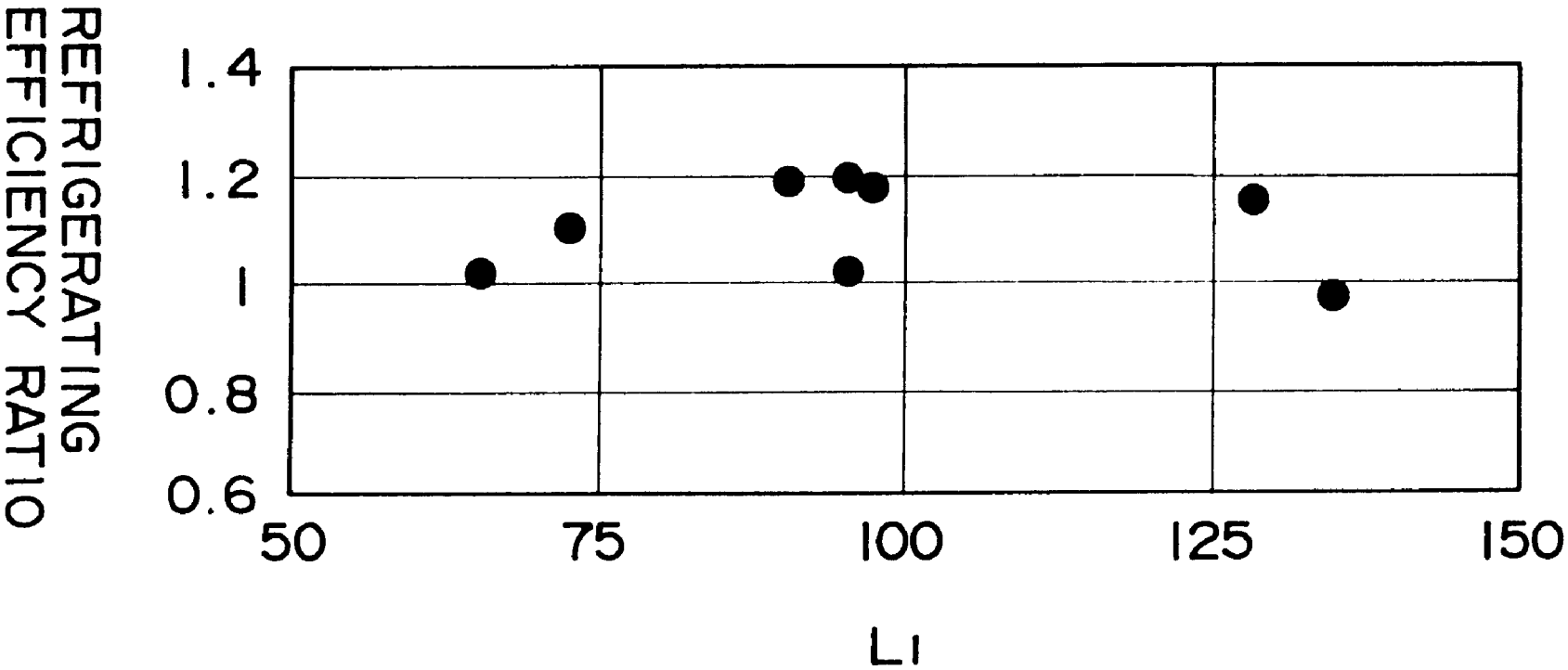
FIG. 7 is a graph showing a relationship between L1 and a refrigerating efficiency ratio.
Figure 8:
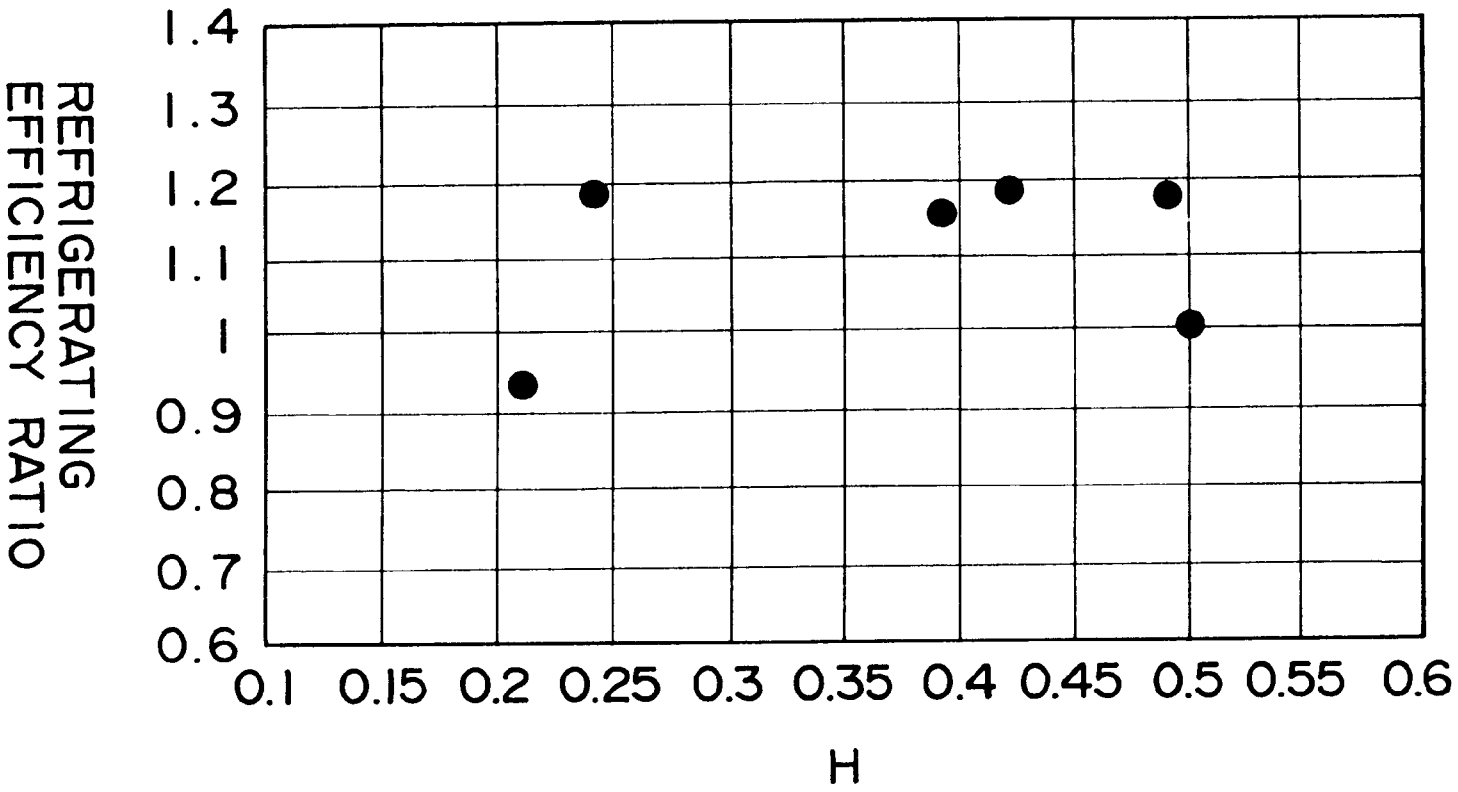
FIG. 8 is a graph showing a relationship between H and a refrigerating efficiency ratio.
Figure 9:
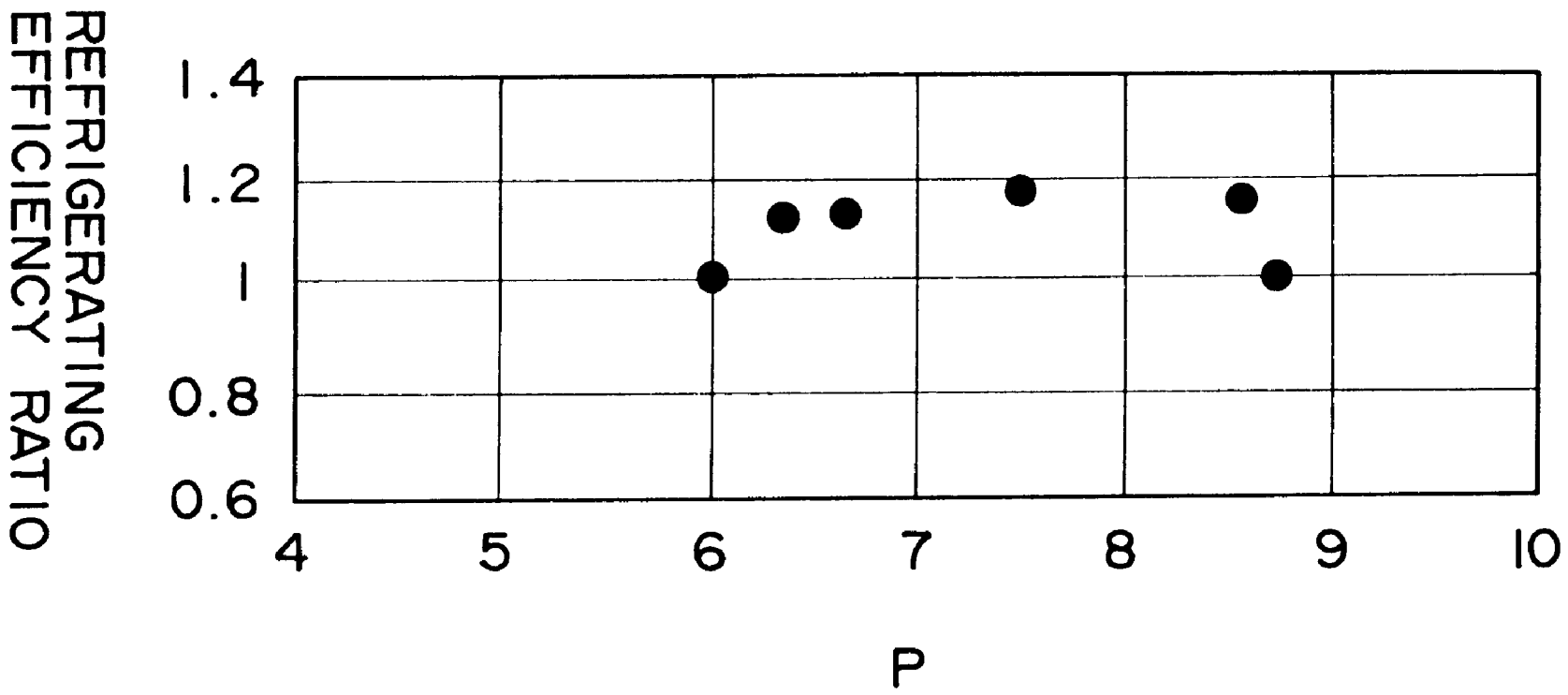
FIG. 9 is a graph showing a relationship between P and a refrigerating efficiency ratio.
Figure 10:
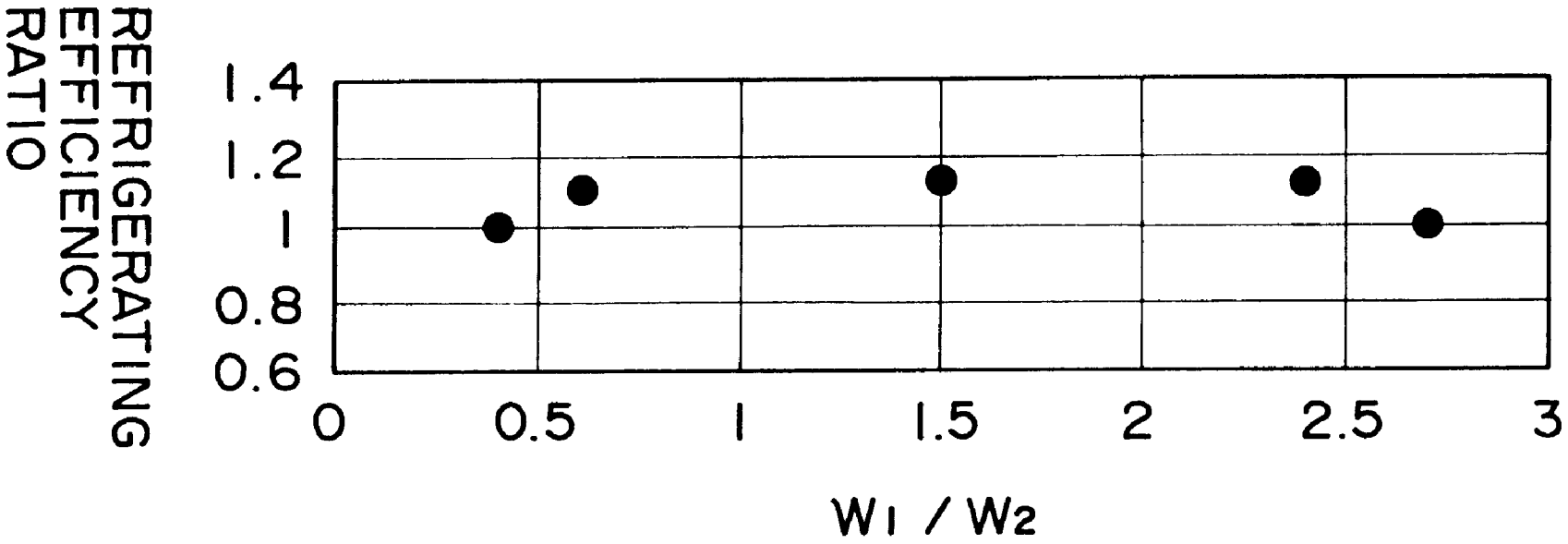
FIG. 10 is a graph showing a relationship between W1/W2 and a refrigerating efficiency ratio.
Figure 11:
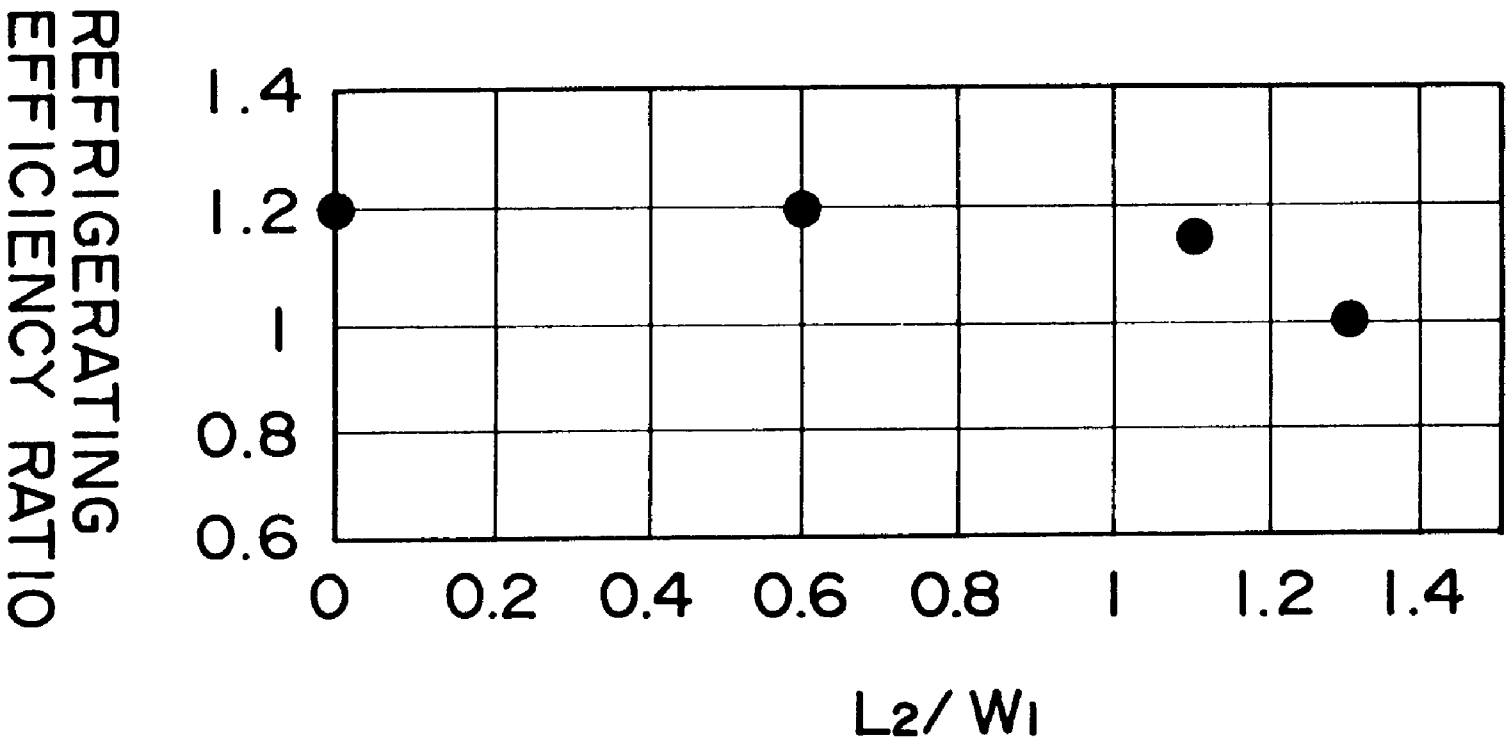
FIG. 11 is a graph showing a relationship between L2/W1 and a refrigerating efficiency ratio.

Preferred embodiments of the present invention will be described in detail hereinafter with reference to the accompanying drawings. FIG. 1 is a side view showing the entirety of a heat transfer tube for an absorber according to an embodiment of the present invention; FIG. 2 is a partly enlarged view thereof; and FIGS. 3 and 4 are sectional views taken on line 3—3 and on line 4—4, respectively, of FIG. 2. As shown in FIG. 1, on the outer surface of a metal tube, areas 3 formed with crest portions and trough portions and arcuate smooth areas 4 not formed with crest portions and trough portions are provided alternately in the axial direction of the tube. The crest and trough areas 3 are provided on almost all of the areas of the metal tube, and the smooth areas 4 are provided in a very short area including the ends and the center of the tube. The heat transfer tube is mounted on a tube plate or the like of the refrigerating machine through the smooth areas 4. A smooth portion can be arranged at a position corresponding to a baffle plate of the refrigerating machine. Accordingly, a clearance between the hole of the tube plate and the tube can be made small, and a fretting corrosion of the tube caused by the rubbing of the tube and the tube plate each other due to vibrations during the operation of the refrigerating machine can be suppressed.

As shown in FIG. 2, in the crest and trough area 3, trough portions 1 having a given length L1 extending in the longitudinal direction of the tube are formed at given intervals in the circumferential direction, and a group of trough portions is constituted by one group of a plurality (N) of trough portions 1 arranged in the circumferential direction. A plurality of the groups of trough portions are arranged in the longitudinal direction of the tube. The adjacent groups of trough portions are arranged so that in the intermediate position of each trough portion 1 of one group of trough portions is slightly entered each trough portion 1 of the other group of trough portions. The length of the trough portion 1 entering between the adjacent groups of trough portions (i.e., overlap) is L2.

As shown in FIGS. 3 and 4, when viewed in the circumferential direction, the portion not formed with the trough portion 1 is in the outer periphery of the circle before processing of the trough portion, and after forming of the trough portion, said portion not formed with the trough portion constitutes a protrusion outside. On the other hand, the trough portion 1 has the depth H in the outer circumferential surface, but in the inner circumferential surface, the trough portion protrudes internally of the tube with the height H as compared with the portion in the outer periphery of the circle.

The width of the trough portion 1 (the circumferential length in the circumferential direction of the tube) is set to W1, and the width of the crest portion 2 formed between the trough portions 1 (the circumferential length in the circumferential direction of the tube) in the circumferential direction of the tube is set to W2. Further, the pitch of the trough portion 1 in the circumferential direction is set to P (=π D/N) along the outer surface of the tube. Here, W1 and W2 are defined as follows. That is, as shown in FIG. 4 (*b*), a circumscribed circle of the crest and trough portions is represented by the broken line. As shown in FIG. 4 (*a*), the diameter of the circumscribed circle is D. The arcuate length in the trough portion 1 between points of intersection at which an extending line of the arc of the trough portion 1 crosses the circumscribed circle is set to W1, and the arcuate length in the crest portion 2 between the points of intersection is set to W2.

The first feature of the present invention is to increase the amount of the absorbing liquid staying in the trough portions 1, and to spread the absorbing liquid as much as possible on the outer surface of the tube to thereby widely form a thin liquid film to increase the absorbing function of the liquid, thus promoting the performance. Therefore, in the present invention, the length L1 of the trough portion fulfills the following formula 1.

$$70\ \text{mm} \leqq L1 \leqq 130\ \text{mm} \quad (1)$$

In the prior application, L1 is set in the range of 10 to 50 mm. This reduces the absorbing liquid staying in the trough portions and reduces the circulating amount of the absorbing liquid. However, in the present invention, by setting L1 in the range as described above, the absorbing liquid staying in the trough portions 1 is increased as much as possible, and the absorbing function of the liquid is increased to promote the performance. If L1 exceeds 130 mm, a deviation occurs in the flow-down of the absorbing liquid to lower the absorbing performance. On the other hand, in the area where L1 is smaller than 70 mm, the residual amount of the liquid reduces to lower the absorbing performance. Therefore, it is necessary to fulfill the formula 1.

Further, the depth H of the trough portion 1 need to fulfill the following formula 2.

$$0.23\ \text{mm} \leqq H < 0.5\ \text{mm} \quad (2)$$

By setting the depth H of the trough portion 1 to the range defined in the formula 2, it is possible to adequately stay the absorbing liquid within the trough portions 1, and to promote the wet spreading properties thereof on the outer surface of the tube to form a thin liquid film thereby promoting the absorbing performance caused by the absorbing liquid. If the depth H exceeds 0.5 mm, a thick liquid film is present on the outer surface of the tube so that heat is radiated on the surface of the liquid film whereas the heat transfer resistance caused by the liquid film increases to lower the performance. On the other hand, if the depth H is less than 0.23 mm, the residence time of the absorbing liquid is so short that the absorbing liquid flows down while not carrying out the absorption as required. Therefore, the depth H of the trough portion 1 is set in the range of 0.23 mm≦H<0.5 mm.

Further, the pitch P (=π D/N) along the outer circumstance of the tube of the trough portion 1 in the circumferential direction need to fulfill the following formula 3.

$$6.2\ \text{mm} \leqq P \leqq 8.7\ \text{mm} \quad (3)$$

If the pitch P along the outer circumstance of the tube of the trough portion 1 in the circumferential direction is less than 6.2 mm, the trough portion is relatively excessively large to make it hard to form a thin liquid film. On the other hand, if the pitch P exceeds 8.7 mm, smooth portions increase, and portions where the convection of the absorbing liquid takes place decrease to lower the absorbing performance caused by the absorbing liquid. Therefore, the circumferential pitch P of the trough portion 1 is set in the range of 6.2 to 8.7 mm.

Preferably, the ratio W1/W2 of a width W1 of the trough portion 1 to a width W2 of the crest portion fulfills the following formula 4.

$$0.5 \leqq W1/W2 \leqq 2.5 \quad (4)$$

The widths W1 and W2 fulfill the formula 4 whereby the absorbing liquid is adequately stayed, and pressure loss of cooling water in the tube can be suitably maintained. If the ratio W1/W2 exceeds 2.5, a flowpassage area in section at right angles to the axis of the tube is excessively small, and the pressure loss of cooling water in the tube increases. The transfer of cooling water is done by an electric pump. However, when the pressure loss increases, a pump having a large output is required, and the comprehensive energy efficiency of the machine lowers. On the other hand, if the ratio W1/W2 is smaller than 0.5, the absorbing performance lowers because the retaining amount of the absorbing liquid is not enough.

The second feature of the present invention is to shorten the length L2 of the portion where the trough portion 1 enters to enable setting large the number of installations of the trough portion 1 in the circumferential direction of the tube and the width W1 of the trough portions 1. As a result, the residual amount of the absorbing liquid on the surface of the tube increases to promote Marangoni convection, thus promoting the absorbing performance.

Accordingly, in the present invention, preferably, the length L2 of the portion where the trough portion 1 enters fulfills the following formula 5 with respect to the width W1 in the circumferential direction of the tube of the trough portion 1.

$$0 \leqq L2 \leqq 1.2\ W1 \quad (5)$$

The length L2 of the portion where the trough portion 1 enters is determined as in the formula 5 according to the width W1 of the trough portion 1 whereby the width W1 of the trough portion can be widened, and the width W2 of the crest portion 2 can be set small so that the number of the crest portions in the circumferential direction can be increased.

If L2 exceeds 1.2 W1, the pitch at which the trough portions are arranged in the circumferential direction is so large that the number of the trough portions reduces or the adjacent trough portions are linked in the axial direction of the tube to lower the function for holding the liquid. On the other hand, if L2 is less than 1.2 W1, the above-described phenomenon is reversed, the pitch at which the trough portions are arranged is narrow to increase the number of the trough portions.

On the other hand, in the prior application, L2 was defined with respect to L1, and L2/L1 was set in the range of 0.2 to 0.8 mm. With this, the absorbing liquid tends to be made up. However, the disadvantage is that since the superposition of the trough portions is so long that many trough portions cannot be provided in the circumferential direction. That is, L2/L1 exceeds 0.3, when the superposition of L2 is long, W1<W2 results. Therefore, many trough portions cannot be provided, and the width of the trough portions is narrow. In the case where L2/L1 exceeds 0.3, it is necessary, in order to provide many trough portions, to absolutely make W1 small and to make small the arranging pitch of the trough portions in the circumferential direction. As a result, there is a disadvantage that the residual amount of the liquid in the trough portions is small, failing to obtain the high absorbing performance.

The trough portions 1 are formed so that the numerical values are within the above-described range whereby the residual amount of the absorbing liquid on the surface of the tube increases, the Marangoni convection is promoted, and the absorbing performance is enhanced.

It is to be noted that the metal tube constituting the heat transfer tube in the present invention of course includes an alloy tube, and various metal or alloy tubes such as a copper or aluminum tube and its alloy tubes or a steel tube can be used.

EXAMPLES

The effects of Examples of the present invention will be described hereinbelow in comparison with Comparative Examples departed from the scope of the present invention. The testing conditions are given in Table 1 below.

TABLE 1

| | |
|---|---|
| pressure in absorber chamber | 6.0 mm Hg |
| Solution inlet concentration | 63 weight % |
| Solution inlet temperature | 55° C. |
| Cooling water flow velocity | 1.50 m/s |
| Cooling water inlet temperature | 32.0° C. |
| Liquid film flowrate | 0.017–0.035 kg/m · sec |
| Surfactant | Addition of 2 ethyl hexanol |

The following TABLES 2 and 3 show shapes and dimensions of heat transfer tubes in Examples and Comparative Examples. Numerical values are those used in FIGS. 2 and 4.

TABLE 2

| | No. | D | Wall thick. of tube | L1 | L2/W1 | P | H | W1/W2 |
|---|---|---|---|---|---|---|---|---|
| Example | 1 | 15.88 | 0.7 | 95 | 0.60 | 6.24 | 0.41 | 1.5 |
| | 2 | 19.05 | 0.7 | 90 | 0.60 | 6.65 | 0.41 | 1.5 |
| | 3 | 22.23 | 0.7 | 97 | 0.60 | 6.98 | 0.40 | 1.49 |
| Comp. | 4 | 15.88 | 0.7 | 65 | 0.60 | 6.24 | 0.41 | 1.5 |
| Example | 5 | 19.05 | 0.7 | 135 | 0.60 | 5.54 | 0.51 | 1.5 |
| | 6 | 19.05 | 0.7 | 95 | 0.6 | 9.97 | 0.41 | 1.5 |
| Example | 7 | 19.05 | 0.7 | 72 | 0.60 | 6.64 | 0.41 | 1.5 |
| | 8 | 19.05 | 0.7 | 128 | 0.60 | 6.64 | 0.39 | 1.5 |
| | 9 | 19.05 | 0.7 | 90 | 0.60 | 6.64 | 0.24 | 1.5 |
| | 10 | 19.05 | 0.7 | 90 | 0.60 | 6.64 | 0.49 | 1.5 |
| Comp. | 11 | 19.05 | 0.7 | 90 | 0.60 | 6.64 | 0.21 | 1.5 |
| Example | 12 | 19.05 | 0.7 | 90 | 0.60 | 6.64 | 0.50 | 1.5 |
| Example | 13 | 19.05 | 0.7 | 94 | 0.60 | 7.84 | 0.39 | 1.5 |
| | 14 | 19.05 | 0.7 | 94 | 0.60 | 8.55 | 0.39 | 1.5 |
| | 15 | 19.05 | 0.7 | 94 | 0.60 | 6.34 | 0.39 | 1.5 |

TABLE 3

| | No. | D | Wall thick. of tube | L1 | L2/W1 | P | H | W1/W2 |
|---|---|---|---|---|---|---|---|---|
| Comp. | 16 | 19.05 | 0.7 | 94 | 0.60 | 5.98 | 0.39 | 1.5 |
| Example | 17 | 19.05 | 0.7 | 94 | 0.60 | 8.73 | 0.39 | 1.5 |
| Example | 18 | 19.05 | 0.7 | 90 | 0.60 | 6.65 | 0.41 | 2.4 |
| | 19 | 19.05 | 0.7 | 90 | 0.60 | 6.65 | 0.41 | 0.6 |
| Comp. | 20 | 19.05 | 0.7 | 90 | 0.60 | 6.65 | 0.41 | 2.7 |
| Example | 21 | 19.05 | 0.7 | 90 | 0.60 | 6.65 | 0.41 | 0.4 |
| Example | 22 | 19.05 | 0.7 | 91 | 1.10 | 6.65 | 0.41 | 1.5 |

TABLE 3-continued

| | No. | D | Wall thick. of tube | L1 | L2/W1 | P | H | W1/W2 |
|---|---|---|---|---|---|---|---|---|
| | 23 | 19.05 | 0.7 | 91 | 0 | 6.65 | 0.41 | 1.5 |
| Comp. | 24 | 19.05 | 0.7 | 91 | 1.3 | 6.65 | 0.41 | 1.5 |
| Example | 25 | 19.05 | 0.7 | — | — | — | — | — |

The following TABLES 4 to 8 show, in the heat transfer tubes in Examples and Comparative Examples, the refrigerating efficiency of evaporators representative of the absorbing efficiency by the ratio of the smooth tube. FIGS. 7 to 11 show data shown in TABLES 4 to 8.

TABLE 4

| | No. | L1 | Refrigerating efficiency of evaporator by ratio of smooth tube |
|---|---|---|---|
| Comp. Example | 4 | 65 | 1.01 |
| Example | 7 | 72 | 1.1 |
| Example | 2 | 90 | 1.19 |
| Example | 1 | 95 | 1.19 |
| Example | 3 | 97 | 1.18 |
| Comp. Example | 6 | 95 | 1.01 |
| Example | 8 | 128 | 1.15 |
| Comp. Example | 5 | 135 | 0.97 |

TABLE 5

| | No. | H | Refrigerating efficiency of evaporator by ratio of smooth tube |
|---|---|---|---|
| Comp. Example | 11 | 0.21 | 0.93 |
| Example | 9 | 0.24 | 1.18 |
| Example | 8 | 0.39 | 1.15 |
| Example | 2 | 0.42 | 1.18 |
| Example | 10 | 0.49 | 1.17 |
| Comp. Example | 12 | 0.5 | 1 |

TABLE 6

| | No. | P | Refrigerating efficiency of evaporator by ratio of the smooth tube |
|---|---|---|---|
| Comp. Example | 16 | 5.98 | 1.01 |
| Example | 15 | 6.34 | 1.13 |
| Example | 9 | 6.64 | 1.14 |
| Example | 2 | 6.65 | 1.15 |
| Example | 7 | 6.64 | 1.12 |
| Example | 13 | 7.48 | 1.18 |
| Example | 14 | 8.55 | 1.16 |
| Comp. Example | 17 | 8.73 | 1.01 |

TABLE 7

| | No. | W1/W2 | Refrigerating efficiency of evaporator by ratio of smooth tube |
|---|---|---|---|
| Comp. Example | 21 | 0.4 | 1 |
| Example | 19 | 0.6 | 1.1 |

TABLE 7-continued

| | No. | W1/W2 | Refrigerating efficiency of evaporator by ratio of smooth tube |
|---|---|---|---|
| Example | 2 | 1.5 | 1.13 |
| Example | 18 | 2.4 | 1.12 |
| Comp. Example | 20 | 2.7 | 1 |

TABLE 8

| | No. | L2/W1 | Refrigerating efficiency of evaporator by ratio of smooth tube |
|---|---|---|---|
| Example | 23 | 0 | 1.18 |
| Example | 2 | 0.6 | 1.19 |
| Example | 22 | 1.1 | 1.14 |
| Comp. Example | 24 | 1.3 | 1.01 |

As will be shown in TABLES 4 to 8 and FIGS. 7 to 11, the refrigerating efficiency of the evaporator in Examples was 1.1 or more, while that in Comparative Examples was low, less than 1.01.

As described above, according to the present invention, since a large amount of the absorbing liquid stay on the outer surface of the tube and thinly spread on the surface of the tube, the absorbing function of the absorbing liquid is increased, and the absorbing performance can be enhanced.

The entire disclosure of Japanese Patent Applications No. 9-12937 filed on Jan. 27, 1997 and No. 9-340372 filed on Dec. 10, 1997 including specification, claims, drawings and summary are incorporated herein by reference in its entirety.

What is claimed is:

1. A heat transfer tube for an absorber wherein on an outer surface of a metal tube having an outer diameter of D, a plurality of groups of N (N is a natural number) number of trough portions, wherein the length L1 in a longitudinal direction of the tube is 70 mm$\leqq$L$\leqq$130 mm, and the depth H is 0.23 mm$\leqq$H<0.5 mm, is formed on a circumference of a circle formed in section of the tube, said groups each being arranged such that for a cut perpendicular to a longitudinal direction of the tube the pitch P(=$\pi$D/N) is in the range of 6.2 to 8.7 mm, said groups of trough portions being spaced in a longitudinal direction of the tube, wherein adjacent ones of said groups in the longitudinal direction of the tube are arranged so that the ends of each trough portion of the adjacent groups overlap each other.

2. The heat transfer tube for an absorber according to claim 1, wherein let W1 be the width in the direction perpendicular to the longitudinal direction of the tube of said trough portion formed in the outer surface of the metal tube, and W2 be the width in the direction perpendicular to the tube of a crest portion formed between the trough portions arranged on the circumference of the circle formed in section of the tube in the case of being cut perpendicular to the longitudinal direction of the tube, 0.5$\leqq$W1/W2$\leqq$2.5 is fulfilled.

3. The heat transfer tube for an absorber according to claim 1, wherein let L2 be the length of a portion in which the trough portions of the group of trough portions adjacent to the longitudinal direction of the tube are entered each other, 0$\leqq$L2/W1$\leqq$1.2 is fulfilled.

* * * * *